US005992044A

United States Patent [19]

Hanig

[11] Patent Number: 5,992,044

[45] Date of Patent: Nov. 30, 1999

[54] METHOD AND APPARATUS FOR DRYING GRAIN

[75] Inventor: John A. Hanig, Sheffield, Iowa

[73] Assignee: Sukup Manufacturing Company, Sheffield, Iowa

[21] Appl. No.: 09/096,909

[22] Filed: Jun. 12, 1998

[51] Int. Cl.[6] ..... F26B 7/00

[52] U.S. Cl. ..... 34/434; 34/436; 34/482; 34/167; 34/181

[58] Field of Search ..... 34/431, 432, 434, 34/436, 482, 65, 166, 167, 174, 179, 181, 233; 432/17, 97, 101

[56] References Cited

U.S. PATENT DOCUMENTS

| | | | |
|---|---|---|---|
| 3,118,574 | 1/1964 | Comte | 222/270 |
| 3,430,354 | 3/1969 | Meredith | 34/172 |
| 4,010,552 | 3/1977 | Peterson | 34/179 |
| 4,149,844 | 4/1979 | Noyes | 432/17 |
| 4,411,620 | 10/1983 | Applegate | 432/29 |
| 4,423,557 | 1/1984 | Westlaken | 34/167 X |
| 4,463,503 | 8/1984 | Applegate | 34/172 |
| 4,463,504 | 8/1984 | Applegate | 34/175 |
| 4,914,834 | 4/1990 | Sime | 34/169 |
| 5,570,521 | 11/1996 | Baker et al. | 34/550 |
| 5,653,043 | 8/1997 | Bestwick et al. | 34/171 |

*Primary Examiner*—Henry Bennett
*Assistant Examiner*—Steve Gravini
*Attorney, Agent, or Firm*—Zarley, McKee, Thomte, Voorhees & Sease

[57] ABSTRACT

A grain dryer has a horizontal plenum connected to a source of heated forced air and has at least one generally perforated wall. A substantially enclosed grain conduit extends along the plenum and has one of its sidewalls being the perforated wall of the plenum. The grain conduit has upper and lower ends to receive and discharge, respectively, a quantity of grain to be dried by heat conveyed to the grain through the perforated wall of the plenum. The lower end of the grain conduit defines an opening generally dwelling in a substantially vertical plane and having upper and lower discharge ports, separated by a plate extending across the central portion thereof to close the flow of grain therethrough. Generally horizontal upper and lower feed rolls are located in the grain conduit adjacent each of the upper and lower ports, respectively, to induce flow of grain out of the upper and lower ports, with the feed roll adjacent the upper port serving to accelerate the discharge of a layer of hotter grain adjacent the vertical wall of the grain conduit. A flange extends inwardly from the plate in spaced relation to the vertical wall of the grain conduit to guide a layer of hotter grain adjacent to the wall out of the grain conduit.

11 Claims, 3 Drawing Sheets

METHOD AND APPARATUS FOR DRYING GRAIN

BACKGROUND OF THE INVENTION

Existing grain dryers commonly utilize a plurality of longitudinally juxtapositioned hexagonal-shaped grain conduits which have a longitudinal central opening that serves as a heat plenum through which hot air is driven by a suitable fan. At least the inner walls of the plenum are perforated to permit the air to access the hexagonal-shaped conduits to dry the grain therein. The grain typically is introduced into the dryer at the top and moves by gravity in a downward direction while it is being dried. The dried grain is discharged into a conventional elongated auger through a discharge port at the bottom of the conduits. The lower ends of the conduits are typically closed except for a horizontal discharge opening at the lower ends thereof. A horizontal paddle wheel or feed metering roll is mounted adjacent the discharge opening. Its rotation facilitates the movement of the dried grain out of the conduits.

While these existing grain dryers are effective in drying grain, they suffer at least one shortcoming in that the grain adjacent the wall of the conduit that is in common with the heat plenum often becomes quite hot and the grain in that layer is damaged. The damage usually is reflected by stress cracks in grain which results in inferior quality. That hotter layer is dryer than the remaining wetter grain in the conduit. When the very dry grain is subsequently mixed with the wetter grain, a non-uniform quality of the mixed grain results.

It is therefore a principal object of this invention to provide a method and apparatus for drying grain in such a conventional dryer wherein the quality of the grain will be enhanced and the layer of grain against the common wall with the heat plenum will not be damaged by this hotter condition.

A still further object of this invention is to move the layer of grain along the plenum wall more quickly to reduce its temperature and relative degrees so that a more uniform quality of mixed grain is achieved.

These and other objects will be apparent to those skilled in the art.

SUMMARY OF THE INVENTION

A grain dryer has a horizontal plenum connected to a source of heated forced air and has at least one generally perforated wall. A substantially enclosed grain conduit extends along the plenum and has one of its sidewalls being the perforated wall of the plenum. The grain conduit has upper and lower ends to receive and discharge, respectively, a quantity of grain to be dried by heat conveyed to the grain through the perforated wall of the plenum.

The lower end of the grain conduit defines an opening generally dwelling in a substantially vertical plane and having upper and lower discharge ports, separated by a plate extending across the central portion thereof to close the flow of grain therethrough. Generally horizontal upper and lower feed rolls are located in the grain conduit adjacent each of the upper and lower ports, respectively, to induce flow of grain out of the upper and lower ports, with the feed roll adjacent the upper port serving to accelerate the discharge of a layer of hotter grain adjacent the vertical wall of the grain conduit.

A flange extends inwardly from the plate in spaced relation to the vertical wall of the grain conduit to guide a layer of hotter grain adjacent to the wall out of the grain conduit.

DESCRIPTION OF THE PREFERRED EMBODIMENT

Figure 1:
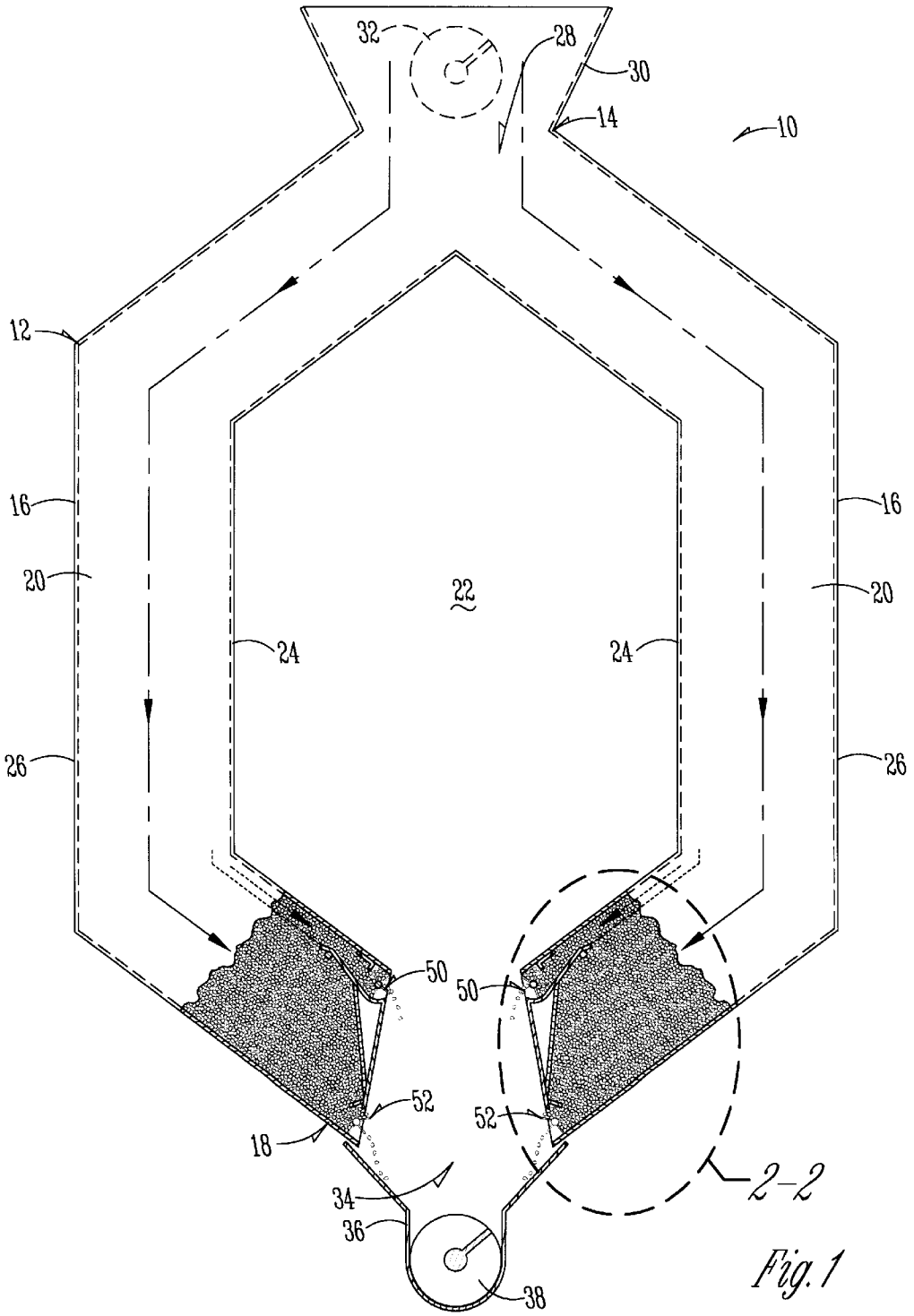
FIG. 1 is an enlarged sectional view taken on line 1—1 of FIG. 4.
Figure 3:
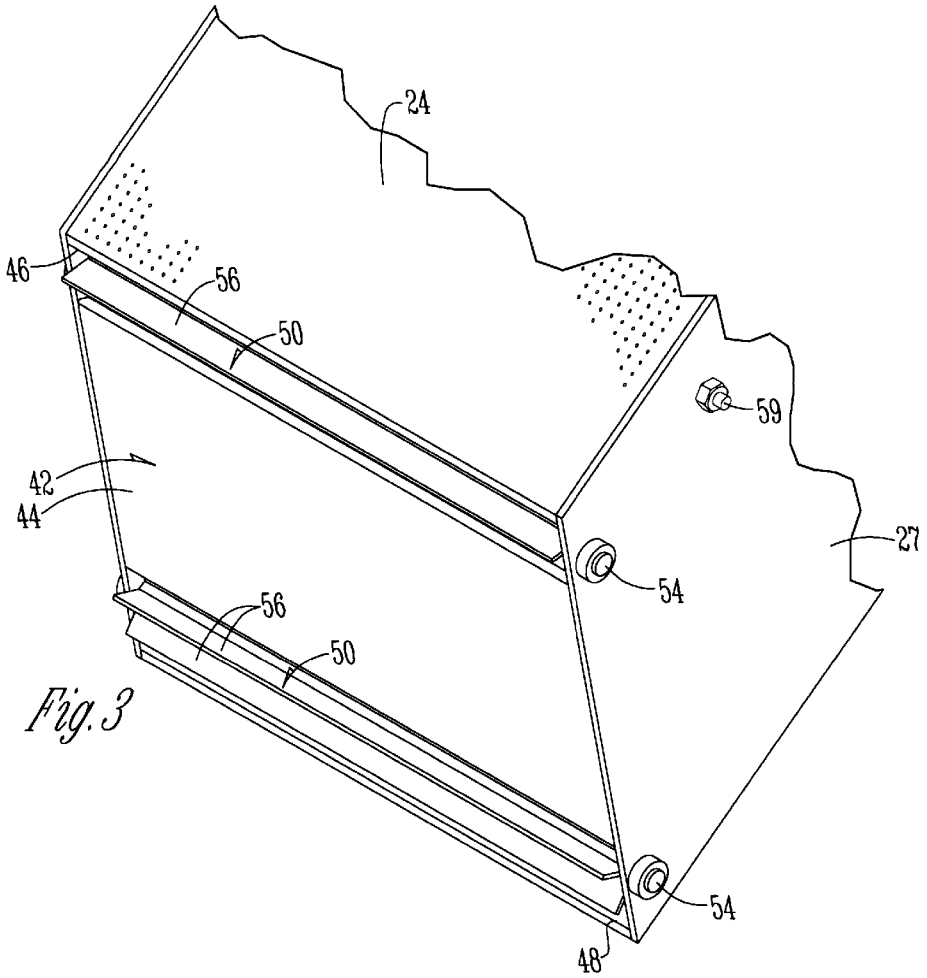
FIG. 3 is an enlarged scale perspective view of the lower end of an individual grain conduit.
Figure 4:
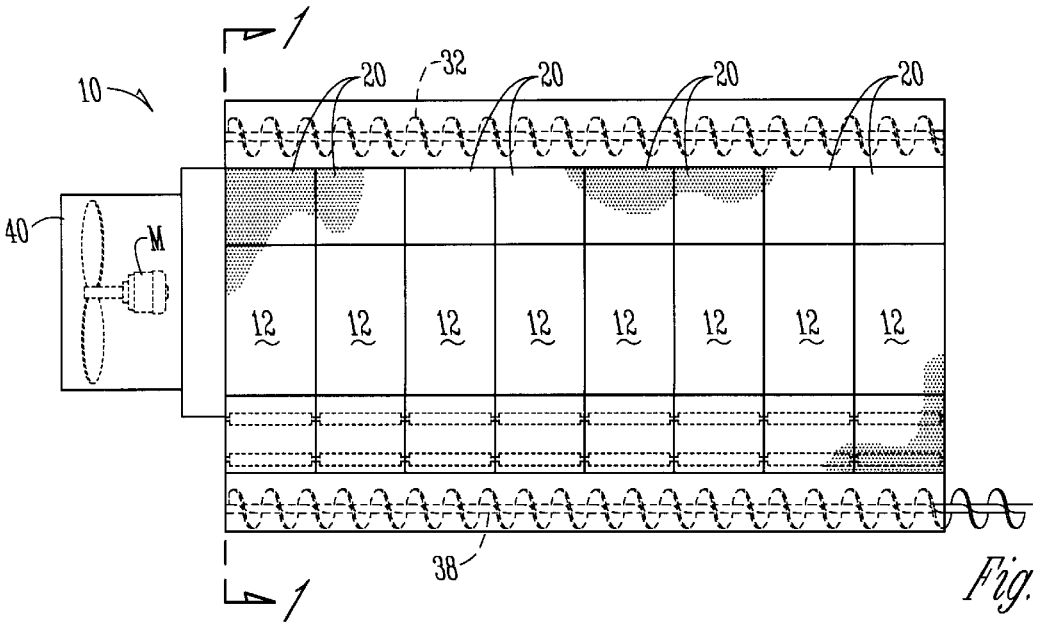
FIG. 4 is a smaller scale side elevational view of the device of this invention.

A substantial portion of the grain dryer of this invention is of conventional structure, and that conventional structure will first be described. The grain dryer 10 as best shown in FIGS. 1 and 4 has a plurality of juxtapositioned grain conduit sections 12 which are hexagonal in shape (FIG. 1). The conduit sections 12 have a top 14, sides 16, and a bottom 18. The grain sections 12 have opposite grain conduits 20 which define a central horizontal longitudinal heat plenum 22. The grain conduits have perforated inner walls 24, perforated outer walls 26 (FIG. 1) and sidewalls 27 (FIG. 3). The grain dryer 10 has an upper grain inlet port 28 in communication with each of the grain conduits 20 with an upper grain inlet hopper 30 extending thereover. A conventional grain feeding auger 32 is mounted in the hopper 30 and is powered by any convenient motor or the like (not shown). The grain dryer 10 has a lower grain discharge port 34 in communication with each of the grain conduits. A lower grain discharge hopper 36 is mounted below the discharge port 34, and a conventional discharge auger 38 is mounted in hopper 36 (FIG. 1). Auger 38 is powered by any conventional electrical motor or the like (not shown).

A conventional blower associated with a source of hot air (not shown) is mounted on the end of the dryer 10 as best shown in FIG. 4. The opposite end of dryer 10 is closed.

Again, the foregoing structure is conventional and does not of itself comprise the essence of this invention.

Figure 2:
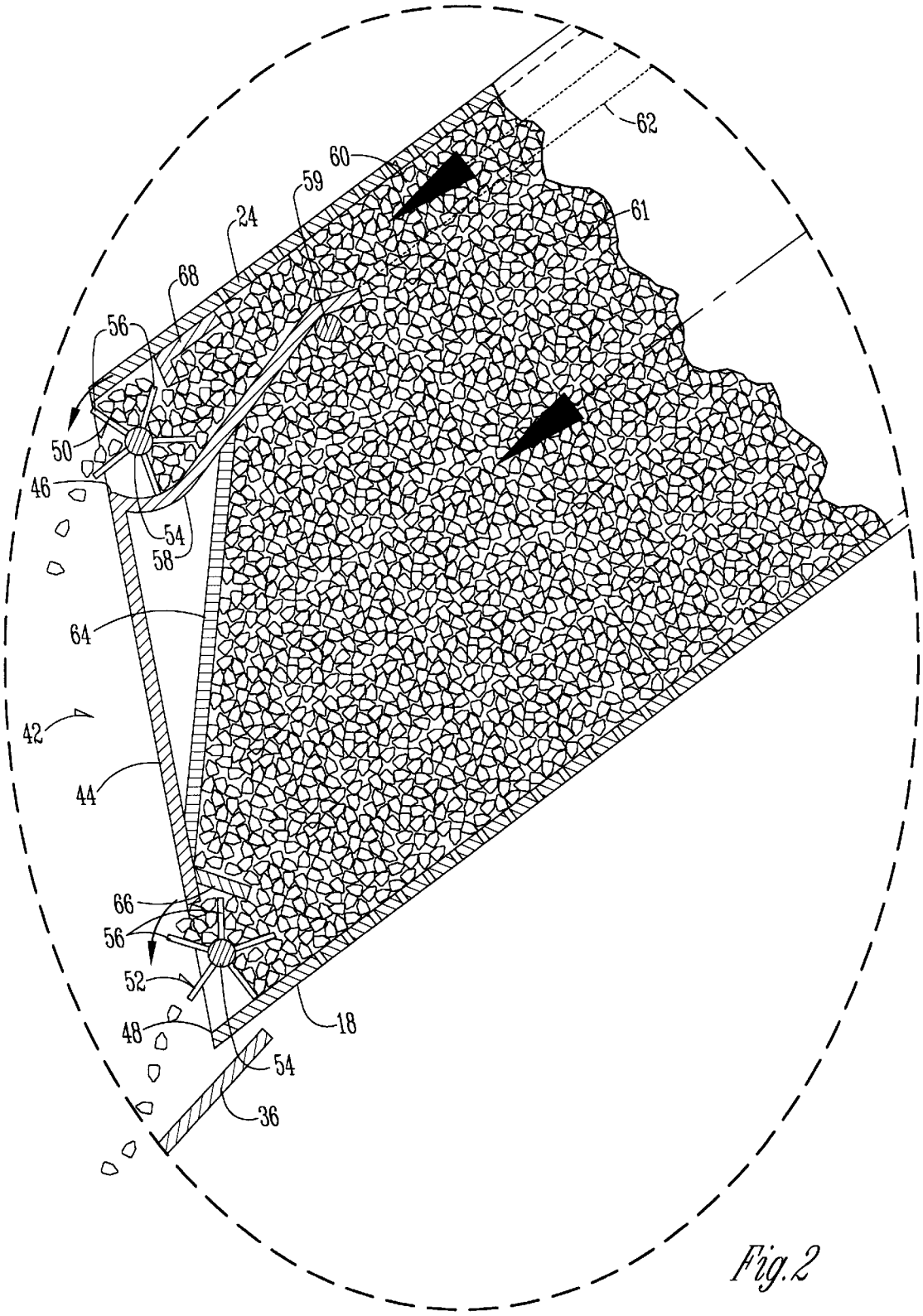
FIG. 2 is an enlarged scale sectional view taken on line 2—2 of FIG. 1.

Each of the grain conduits 20 have a lower end opening 42 as best shown in FIGS. 1, 2 and 3. A central plate 44 extends across the center part of opening 42 to create a horizontal elongated upper discharge port 46 and a similar lower discharge port 48 (FIGS. 2 and 4). Each of the discharge ports 46 and 48 have associated therewith an upper feed or metering roll 50, and a lower feed or metering roll 52, respectively. The rolls are comprised of an elongated shaft 54 with a plurality of radially extending paddles 56 (FIG. 2). The shafts run the length of the dryer (FIG. 4) and are powered by any suitable electrical motor or the like (not shown). The shaft of the upper roll 50 can be variably controlled to cause it to rotate at a higher speed than the lower shaft, if desired. The precise orientation of the ports 46 and 48 relative to each other is not critical to this invention except that the port 46 should be adjacent the wall 24.

As best shown in FIG. 2, a flange 58 with reinforcing bar 59 is secured to plate 44 and extends around the peripheral path of the upper feed roll 50, and thence into the conduit 20. The inner end of the flange 58 is spaced from the inner wall 24 a distance to encompass the thickness of a layer 60 of hotter grain which is the grain that exists near wall 24 through which hot air is initially introduced into the conduits 20 from the plenum 22. The numeral 61 (FIG. 2) designates the layer of cooler grain that resides below the hotter layer of grain 60. The line 62 in FIG. 2 designates the general thickness of the hotter grain layer 60 and this is normally 1 to 4". The flange 58 can be adjustably secured to plate 44 to vary the thickness of layer 60.

As shown in FIG. 2, a baffle plate 64 extends downwardly and outwardly from the under side of flange 58 and terminates slightly above the lower discharge port 48. This baffle plate serves to guide the cooler grain 61 towards the lower discharge port 48. The plate prevents the accumulation of stagnant grain in that area and avoids stagnant non-moving grain. An elongated lip element 66 is secured to the bottom edge of plate 44 and extends downwardly and inwardly into the conduit 20 and terminates in a position to efficiently direct and control the movement of the grain 61 into operative engagement with the paddles 56 of the lower feed roll 52. The feed rolls 50 and 52 rotate in the direction of the arrows indicated in FIG. 2.

The addition of the upper discharge port 46 and the upper feed roll 50 to the conventional structure described heretofore permits the rapid discharge of the hotter layer of grain 60 from the conduits 20. By accelerating the rate of discharge of the hotter layer 60 from the conduits 20, the time that the layer is exposed to the perforated wall 24 is substantially reduced, thereby reducing its temperature and dryness, to reduce the likelihood of damage to the grain in that layer, and to improve the overall uniformity of the subsequently mixed grain.

The lip element 68 mounted adjacent the top feed roll 50 performs the same function for roll 50 that lip element 66 performs for roll 52.

It is therefore seen that this invention will achieve at least all of its stated objectives.

What is claimed is:

1. A grain dryer, comprising, a horizontal heat plenum connected to a source of heated forced air and having at least one generally perforated wall, a substantially enclosed grain conduit extending along said plenum and having one of its walls being the perforated wall of said plenum, said grain conduit having upper and lower ends to receive and discharge, respectively, a quantity of grain to be dried by heat conveyed to grain therein through said perforated wall of said plenum, the lower end of said grain conduit defining, an opening generally dwelling in a substantially vertical plane and having upper and lower discharge ports, and a central portion, a plate extending across said central portion to close the flow of grain therethrough, generally horizontal upper and lower metering rolls in said grain conduit adjacent each of said upper and lower ports, respectively, to induce flow of grain out of said upper and lower ports, with the metering roll adjacent said upper ports accelerating the discharge of a layer of hotter grain adjacent said perforated wall out of said grain conduit.

2. The grain dryer of claim 1 wherein a plurality of identical grain conduits are juxtapositioned longitudinally along said heat plenum.

3. The grain dryer of claim 2 wherein said grain conduits are hexagonal in shape and define a center longitudinal opening which comprises the heat plenum.

4. The grain dryer of claim 3 wherein a longitudinal horizontal grain feed auger extends over inlet ports at the top of said grain conduits, and a longitudinal discharge auger is positioned below the lower ends of said grain conduits to recover dried grain discharged from the upper and lower ports at the lower ends of said conduits.

5. The grain dryer of claim 1 wherein an inwardly extending flange is secured to said plate underneath the upper metering roll to guide an elongated layer of hotter grain in said conduit directly to the upper metering roll and upper port.

6. The grain dryer of claim 5 wherein a baffle plate extends downwardly and outwardly from said flange and terminates above said lower metering roll to guide grain under the hotter layer of grain towards said lower metering roll.

7. The grain dryer of claim 6 wherein a lip member extends downwardly and inwardly from a lower edge of said baffle plate and terminates in spaced relation from said lower metering roll and said lower port to divert grain under the upper layer of grain in a direction substantially normal to the plane of said lower port.

8. A method of improving the quality of grain moving downwardly in a conduit having a wall in common with a heat plenum with the conduit having a lower end terminating in a substantially flat plane, and said common wall terminating adjacent an upper portion of said plane, comprising, forming opposite horizontal discharge openings adjacent the upper and lower edges of said lower end, and simultaneously moving grain out of said conduit through said discharge openings to accelerate the discharge of a layer of grain adjacent said common wall out of the lower end of said conduit by moving said layer of grain to the discharge opening adjacent the upper edge of the lower end of the conduit.

9. A grain dryer, comprising, a heat plenum connected to a source of heated forced air and having at least one generally perforated wall, a substantially enclosed grain conduit extending along said plenum and having one of its walls being the perforated wall of said plenum, said grain conduit having upper and lower ends to receive and discharge, respectively, a quantity of grain to be dried by heat conveyed to grain therein through said perforated wall of said plenum, the lower end of said grain conduit defining an opening generally dwelling in a substantially flat plane and having upper and lower discharge ports, and a central portion, a plate extending across said central portion to close the flow of grain therethrough, generally upper and lower metering rolls in said grain conduit adjacent each of said upper and lower ports, respectively, to induce flow of grain out of said upper and lower ports, with the metering roll adjacent said upper ports accelerating the discharge of a layer of hotter grain adjacent said perforated wall out of said grain conduit.

10. A grain dryer, comprising, a heat plenum connected to a source of heated forced air and having at least one generally perforated wall, a substantially enclosed grain conduit extending along said plenum and having one of its walls being the perforated wall of the plenum, said grain conduit having grain inlet and discharge ends to receive and discharge, respectively, a quantity of grain to be dried by heat conveyed to the grain therein through the perforated wall of the plenum, the discharge end of the grain conduit having first and second spaced discharge ports, first and second metering rolls in said grain conduit adjacent each of said first and second ports to induce flow of grain out of the first and second ports, with the metering roll adjacent the first part accelerating the discharge of a layer of hotter grain adjacent the perforated wall out of the grain conduit.

11. A method of improving the quality of grain moving through a grain conduit having a wall in common with a heat plenum with the conduit having a discharge end, and with the common wall terminating adjacent a first discharge port spaced from a second discharge port located in said flat plane, comprising, simultaneously moving grain out of said conduit through said discharge ports to accelerate the discharge of a hotter layer of grain adjacent said common wall from said conduit by accelerating the movement of said layer of grain out of said first discharge port.

* * * * *